United States Patent [19]

Bradshaw

[11] 4,116,182

[45] Sep. 26, 1978

[54] VARIABLE PERCENTAGE EXHAUST GAS RECIRCULATION VALVE

[75] Inventor: Cyril E. Bradshaw, Kalamazoo, Mich.

[73] Assignee: Eaton Corporation, Cleveland, Ohio

[21] Appl. No.: 808,840

[22] Filed: Jun. 22, 1977

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 9/1973 | Kuehl | 123/119 A |
| 3,880,129 | 4/1975 | Hollis | 123/119 A |
| 4,031,871 | 6/1977 | Hamanishi | 123/119 A |
| 4,069,797 | 1/1978 | Nohira et al. | 123/119 A |
| 4,069,798 | 1/1978 | Thornburgh | 123/119 A |

*Primary Examiner*—Carlton R. Croyle
*Assistant Examiner*—Michael Koczo, Jr.
*Attorney, Agent, or Firm*—Roger A. Johnston

[57] ABSTRACT

An exhaust gas recirculation (EGR) valve for an internal combustion engine in which the rate of flow of exhaust gas from the outlet manifold to the inlet manifold of the engine is controlled as a function of engine load and speed.

6 Claims, 5 Drawing Figures

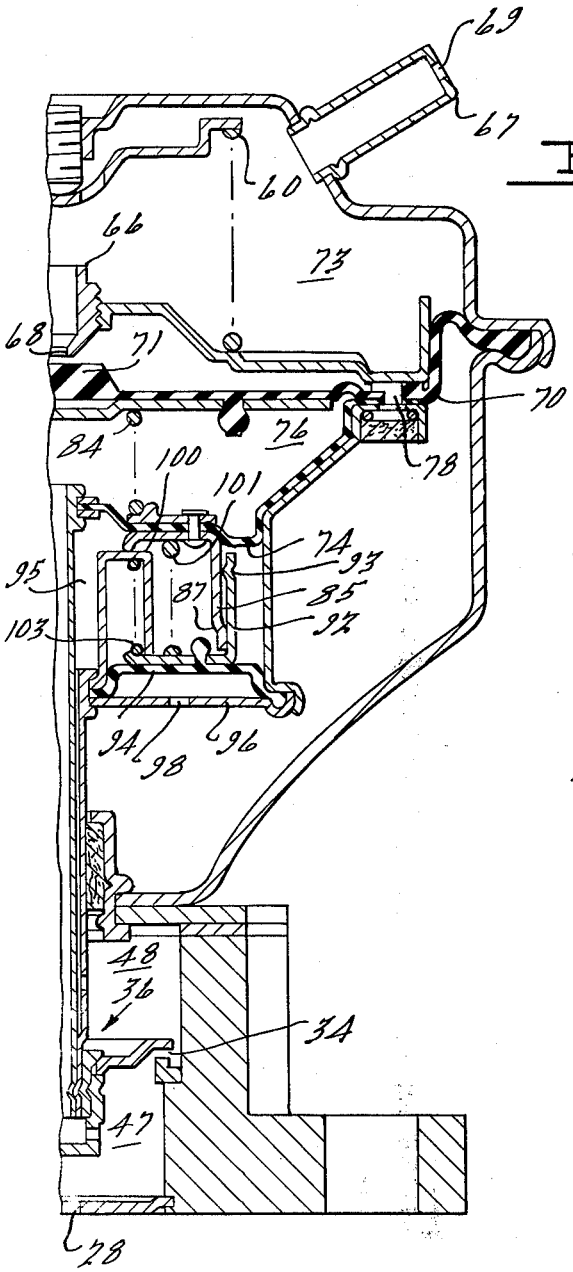
Fig. 3.
Fig. 4.
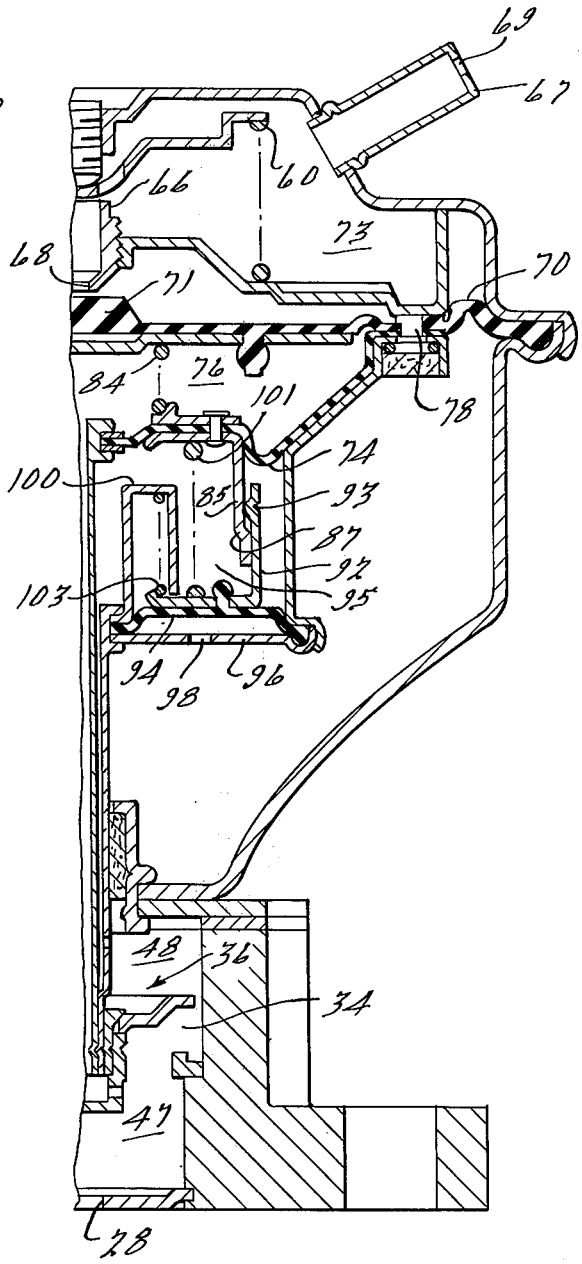

VARIABLE PERCENTAGE EXHAUST GAS RECIRCULATION VALVE

BACKGROUND OF THE INVENTION

1. Field of the Invention

The invention relates generally to exhaust gas recirculation controls for internal combustion engines and particularly relates to such a control wherein the amount of exhaust gas recirculated is varied as a function of engine load and speed.

2. Description of the Prior Art

Control devices are known which provide for the recirculation of exhaust gases through an internal combustion engine to control the emission of oxides of nitrogen. Most have recirculated a fixed percentage of exhaust gases as a function of engine speed and are configured to provide the optimum amount of exhaust gas recirculation during the high load, hard acceleration mode of operation of the engine. They consequently permit more recirculation than is desirable during lightly loaded, higher speed operation. This adversely affects engine performance in terms of reducing the emission of oxides of nitrogen.

Another disadvantage noted in the prior art devices results from their being constructed to effect the control of exhaust gas flow from the engine exhaust manifold to the engine inlet manifold in response to changes in pressure differential between the pressure of the exhaust gases across a fixed control orifice in the exhaust stream. This results in a wide range of pressure differential within normal exhaust system tolerances.

SUMMARY OF THE INVENTION

Responsive to the disadvantages noted in the prior art exhaust gas recirculation valves, it is an object of the present invention to provide an exhaust gas recirculation valve which varies the amount of exhaust gas recirculated in response to engine load and speed.

It is another object to provide an exhaust gas recirculation valve in which flow control is responsive to a pressure differential between exhaust back pressure and a control vacuum level related to engine load.

According to one feature of the present invention, an exhaust gas recirculation valve is provided of the type in which an air bleed valve controls movement of a pressure transducer assembly to move a valve member for controlling recirculation and in which means are provided for variably biasing a moveable member of the air bleed valve in response to changes in engine exhaust back pressure and inlet manifold pressure to effect control of recirculation in response to engine load and speed.

BRIEF DESCRIPTION OF THE DRAWINGS

These and other objects and features will become obvious to those skilled in the art upon reading the accompanying specification with reference to the attached drawings in which:

FIG. 3 is a partial cross sectional view of the invention valve assembly in the position corresponding to Point "A" of FIG. 2;

FIG. 4 is a partial cross sectional view of the invention valve assembly in the position corresponding to a Point "B" of FIG. 2.

DESCRIPTION OF THE PREFERRED EMBODIMENT

Figure 1:
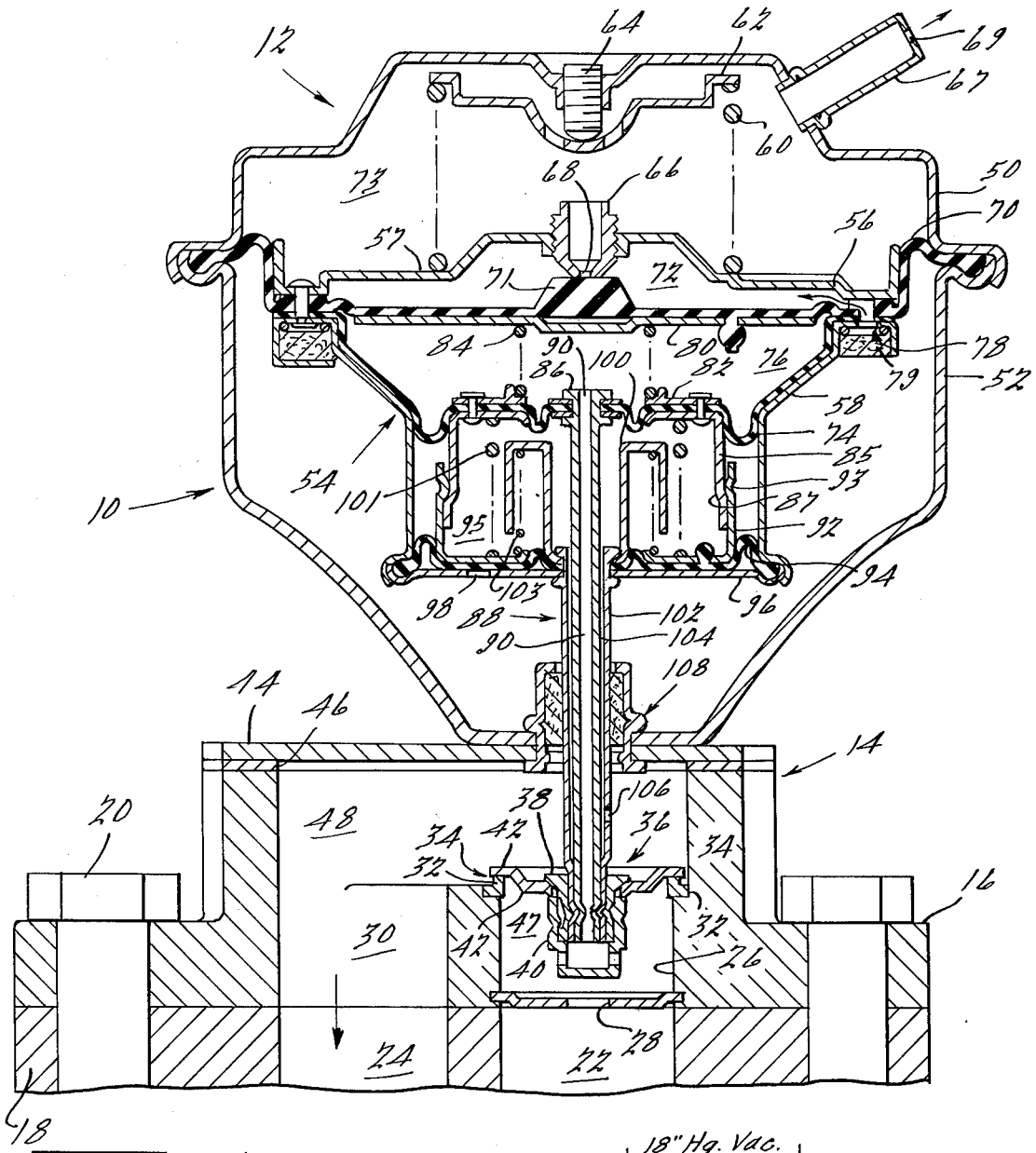
FIG. 1 is a cross sectional view of the invention exhaust gas recirculation valve assembly in its closed position.

Referring now to FIG. 1, an exhaust gas recirculation control valve 10 is illustrated as including generally a control assembly 12 and the recirculating valve assembly 14 operatively connected thereto.

Valve assembly 14 includes a housing 16 adapted to be connected to a manifold boss portion 18 of an internal combustion engine as through a plurality of suitable fasteners 20. The manifold boss portion 18 includes a passage 22 in direct communication with the engine exhaust manifold and an intake passage 24 for recirculating exhaust gases to the engine intake manifold. Provided in the valve housing 16 are exhaust gas inlet 26 in open communication with the exhaust passage 22 through orifice 28 and an exhaust gas outlet 30 in direct fluid communication with the intake passage 24 of the manifold boss portion 18. A seat 32 is fixedly secured to the housing 16 and defines an exhaust gas recirculation orifice 34 with a poppet valve assembly 36 consisting of a hub member 38 and a baffle shell member 40 and a sealing plate or poppet 42 carried for axial movement with the control assembly 12 in essentially the same manner as disclosed in applicant's prior application, Ser. No. 725,069 filed Sept. 21, 1976 and assigned to the assignee of the present invention, which application is incorporated herein by reference. The upper end of the housing 16 is closed by a cover plate 44 secured to the housing 16 by fasteners (not shown) and sealing means such as gasket 46. Thus, when the poppet valve assembly 36 is in the closed position shown in FIG. 1, two chambers are defined within the valve body 16, an exhaust chamber 47 between the fixed orifice 28 and the exhaust gas recirculation orifice 34 and an inlet chamber 48 between the exhaust gas orifice 34 and the manifold boss portion intake passage 24.

Turning now to the control assembly 12, it is illustrated as comprising a fixed upper housing 50, a fixed lower housing 52 which is a webbed structure open to atmosphere, and a moveable transducer assembly 54. The transducer assembly 54 includes an upper housing shell 56 and a lower housing shell 58. Upper housing shell 56 is formed at 57 to provide a seat for a power spring 60 which is supported at its other end by a seat member 62 which is adjustably positionable through movement of an adjusting screw 64 received in the upper housing 52. An air bleed valve fitting 66 defining a fixed orifice 68 is threadedly received in the upper shell member 56, but it would be obvious to one skilled in the art that the orifice might be formed directly through the upper housing shell 56. A fluid fitting 67 is received through the upper housing 50 and defines an orifice 69 to effect communication through a suitable conduit with a vacuum source such as a carburetor venturi.

A pressure responsive member such as the power diaphragm 70 is clampingly received between upper and lower housing members 50, 52 and between upper and lower shell members 56, 58 and an air bleed cavity 72 is thereby defined between the power diaphragm 70 and the upper shell member 56, and a power signal chamber 73 is thereby defined between the diaphragm 70 and the upper housing 50.

The transducer assembly 54 further comprises a control diaphragm 74 which is also clampingly secured between the upper shell member 56 and the lower shell member 58, thereby defining a control cavity 76. A passage 78 is formed through the lower shell member 58, the power diaphragm 70 and control diaphragm 74 to provide communication between the air bleed chamber 72 and the atmosphere through a filter 79 carried by the lower shell member 58. Upper and lower stiffener plates 80, 82 respectively are secured to the power diaphragm 70 and the control diaphragm 74, respectively, and a back pressure control spring 84 is carried therebetween. The control diaphragm 74 is also secured to an inner cage member 85 and to an inner valve stem 86 of valve stem assembly 88.

The inner valve stem member 86 includes an axially extending through passage 90 fluidly communicating at one end with the control chamber 76 and at the other end with the valve housing exhaust chamber.

The inner cage member 85 is a generally cup-shaped member including a flange surface 87 abuttingly engageable with an outer cage member 92 at a cooperating flange surface 93. Outer cage member 92 is secured to an engine load sensing diaphragm 94 which is in turn secured to the lower shell member 58 to define a load sensing cavity 95 by being clampingly secured between the lower shell member 58 and a lower plate member 96 through which are formed a plurality of passages 98 communicating with atmosphere. At its inner periphery, the engine load sensing diaphragm 94 is clampingly secured between the lower plate 96 and an inner spring seat member 100 through a crimping connection effected at the upper end of outer valve stem member 102 of valve stem assembly 88. An inlet manifold pressure control spring 101 is caged between the inner and outer cage members 84, 92; and a neutral bias spring 103 is grounded between the seat member 100 and the outer cage member 92.

Outer valve stem member 102 is a generally hollow cylindrical member sized to receive inner valve stem member 86, defining an annular passage 104 therebetween and includes a plurality of radially extending through passages 106 communicating the annular passage 104 with the valve body inlet passage 48. Outer valve stem member 102 is slidingly received in a bearing assembly 108 which is crimpingly secured to the housing cover 44 and the lower control housing member 52, as was best described in applicant's above referenced application.

DESCRIPTION OF OPERATION

Figure 2:
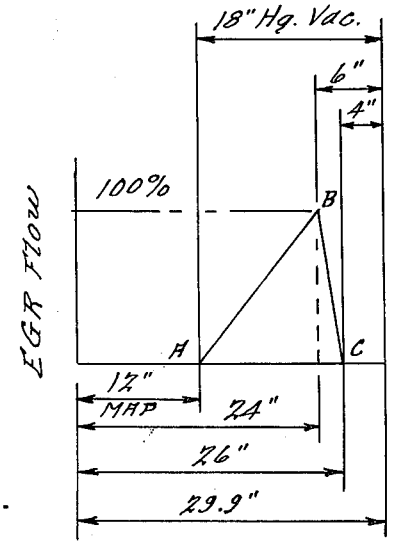
FIG. 2 is a diagrammatic representation of the operation of the invention valve assembly.
Figure 5:
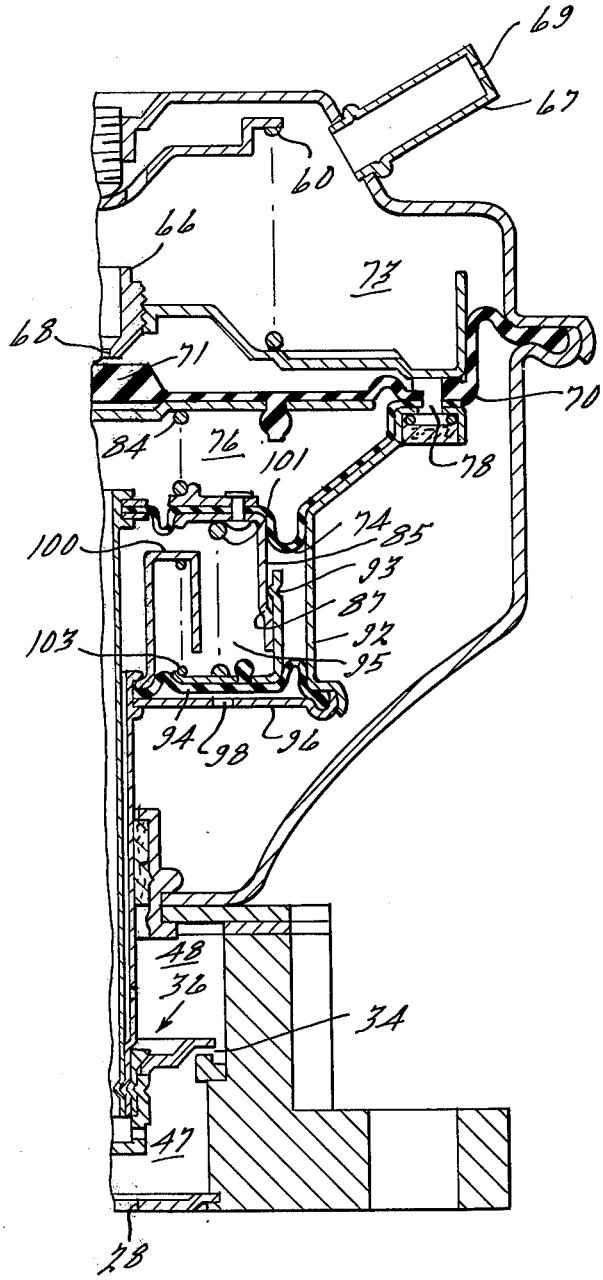
FIG. 5 is a partial cross sectional view of the invention valve assembly in the position corresponding to Point "C" of FIG. 2.

Operation of the invention exhaust gas recirculation (EGR) valve 10 as it is preferably used with an engine driving a vehicle may best be understood by considering the typical plot of engine inlet manifold pressure against percentage EGR flow included as FIG. 2 in conjunction with the FIG. 1 embodiment heretofore described and the illustrations in FIGS. 3–5. It should be understood that the inlet manifold vacuum levels of FIG. 2 are meant to be representative of typical engine operation and are not meant to describe operation of the invention valve assembly in a limiting manner.

The invention valve 10 is illustrated in its neutral position in FIG. 1 wherein the power spring 60 holds the poppet valve assembly 36 in its closed position against the seat 32 to prevent exhaust gas recirculation. The back pressure control spring 84 is urged by control spring 101 and neutral bias spring 103 to apply a light load to urge an enlarged center portion 71 of the power diaphragm 70 against the air bleed valve fitting 66 to close its orifice 68.

Upon starting the engine increasing exhaust gas back pressure is sensed at the passage 22 and is communicated through the fixed orifice 28, the poppet valve assembly 36, and valve stem passage 90 to the control cavity 76 to assist the control spring 84 in loading the control diaphragm 70 against the air bleed valve fitting 66. Simultaneously a vacuum is drawn in the inlet manifold passage 24 which is sensed through the inlet chamber 48 and communicated through the radially extending passages 106 and the annular passage 104 to the engine load sensing cavity 95. Absent imposition of a vacuum demand from the carburetor through the fitting 69 the poppet valve assembly 36 will remain in its illustrated closed position as the inlet manifold vacuum increases and the load on control spring 84 decreases. The vacuum signal will, however, quickly cause the load on control spring 84 to pass through points C and B of the diagram of FIG. 2 until point A is reached at the engine's idling condition, represented here typically as 12 in. Hg manifold absolute pressure (MAP) at zero recirculation flow.

This occurs when upon increasing inlet manifold vacuum toward the level indicated at point C in FIG. 2, the load sensing diaphragm 94 applies a load to the neutral bias spring 103, reaching its assembled preload at point C as may best be seen in FIG. 5. Further increases in vacuum compress the spring 103 and transmit the load through the stiffer rate manifold pressure control spring 101 to vary the biasing load on the back pressure control spring 84 until the outer cage member 92 is stopped on the seat member 100 as may best be seen in FIG. 4 and the load level represented at point B of FIG. 2 is reached. Further increases in manifold vacuum load the control diaphragm 74, which senses the pressure differential between the vacuum in load sensing cavity 95 and the back pressure in the control cavity 76, to compress the control spring 101 and reduce the biasing load on the back pressure control spring 84 as may best be seen in FIG. 3 to the idle loading condition represented at point A in FIG. 2.

When the carburetor throttle linkage demands that the engine drive the vehicle, the engine load increases as evidenced by an increase in MAP from point A. This reverses the start-up sequence described above so that the preload on control spring 84 tends to reach the level permitting operation at point B of FIG. 2.

Exhaust gas recirculation, however, will not take place in any case until the vacuum signal in the power signal chamber 73, which may lag the inlet manifold vacuum signal in load sensing cavity 85, loads the power diaphragm 70 sufficiently to overcome the power spring 60 and move the poppet valve assembly 36 off the seat 32.

In addition to effecting recirculation of exhaust gases this valve opening reduces the pressure in the control cavity 76 to pull the inner portion 71 of the power diaphragm 70 against the control spring 84 to open the air bleed orifice 68. This permits air at atmospheric pressure to enter the power signal chamber 73 reducing the upward force on the power diaphragm 70. This permits the power spring 60 to urge the poppet valve assembly 36 toward its closed position until a stable position is reached wherein the force exerted on the power diaphragm 70 by the pressure in the exhaust chamber 46 and by the load on the control spring 84 are in equilibrium and exhaust gas is flowing as is indicated by the open position of orifice 34 shown in FIGS. 3–5. In FIG. 3 it can be seen that at point "A" the spring seat 100 bottoms on the outer cage member 92, which bottoms on the spring seat 100. Minimal recirculation is effected as the valve assembly 36 is moved off the seat 32 and the center portion 71 of diaphragm 70 is moved from the orifice 68 to the equilibrium position described.

In the preferred embodiment illustrated this exhaust gas flow is controlled by varying the pressure drop across the fixed orifice 28 by operation of the poppet valve assembly 36. When the valve 36 is open, the pressure drop is equal to the sum of the exhaust back pressure upstream of the orifice 28 which varies with engine speed in the passage 22 and the pressure in exhaust chamber 26 which varies with engine load as previously described. It can be seen therefore that during the loading of the engine described the EGR flow varies as a function of both engine speed and load.

As engine load, such as might happen in hard acceleration, increases, the consequent reduction in inlet manifold pressure in inlet chamber 48 results in unloading the inlet manifold pressure control spring 101 and increasing the load on the back pressure control spring 84 until control spring101 is caged by the abuttment of surfaces 79 and 87. At this point (corresponding to point B on the diagram of FIG. 2 and illustrated in FIG. 4) the pressure in exhaust chamber 26 and the load or control spring 84 are in equilibrium at the point of maximum EGR flow. Reference to FIG. 4 will show that at this point the load sensing cavity 95 is expanded to the position described and the power signal chamber 73 and the control cavity 76 are compressed to open the orifice 34 to the maximum position shown.

Any further reduction in inlet manifold vacuum, such as would occur during wide open throttle operation will unload the neutral bias spring 84 so that the EGR flow will reduce along the path B–C of the diagram of FIG. 2. In the position C shown in FIG. 5 the springs 101, 103 are extended to expand load sensing cavity 95 and the net change in the volume of the power and control cavities 73,76 result in the recirculation orifice 34 again being at a minimal opening position.

While only one embodiment of the invention exhaust gas recirculation valve assembly has been described others are possible without departing from the scope of the appended claims.

What is claimed is:

1. In an exhaust gas recirculation valve assembly for controlling the recirculation of exhaust gases between the exhaust manifold and the inlet manifold of an internal combustion engine, the valve assembly being of the type including a pressure transducer assembly operative to move a recirculation valve in response to the pressure level in a power signal chamber and wherein said pressure transducer assembly includes air bleed valve means for controlling the flow of air from atmosphere to the power signal chamber, an improvement comprising:

a. a moveable valve member carried with said air bleed valve means; and b. means operative to apply a force to move said air bleed valve moveable member between a position preventing air flow through said air bleed valve and a position permitting air flow through said air bleed valve in response to changes in engine exhaust back pressure and engine inlet manifold pressure.

2. The improvement as defined in claim 1 and further comprising stop means operative to limit the force applied by said force applying means in response to predetermined valves of said inlet manifold pressure such that increases in said inlet manifold pressure from a minimum valve thereof result in an increase in exhaust gas recirculation to a predetermined maximum and further increases in said predetermined values result in a decrease in exhaust gas recirculation.

3. In an exhaust gas recirculation valve assembly for controlling the recirculation of the exhaust gases between an internal combustion engine exhaust manifold and inlet manifold, said valve assembly being of the type including a pressure transducer assembly operative to move a recirculation valve in response to pressure level in a power signal chamber and wherein said pressure transducer assembly includes air bleed valve means for controlling the flow of air from atmosphere to said power signal chamber, an improvement comprising:

a. moveable valve member carried with said air bleed valve means;

b. means biasing said air bleed valve moveable member in a direction preventing air flow through said air bleed valve; and c. means operative to vary the preload on said biasing means including pressure responsive means responsive to changes in engine exhaust backpressure and engine inlet manifold pressure.

4. The improvement as defined in claim 3 wherein said bias varying means includes:

A. pressure responsive means for defining first and second pressure chambers;

B. means for communicating said first pressure chamber with exhaust manifold back pressure;

C. means for communicating said second pressure chamber with inlet manifold pressure;

D. resilient means operative to bias said pressure responsive means in a direction increasing said preload on said air bleed valve moveable member;

5. The improvement as defined in Claim 3 and further comprising stop means operative to limit the load applied by said preload varying means in response to predetermined values of said inlet manifold pressure such that increases of inlet manifold pressure from a minimum value thereof result in increased recirculation of exhaust gas to a predetermined maximum and further increases beyond said predetermined value result in a decrease in the recirculation of exhaust gas.

6. A valve assembly for controlling the recirculation of exhaust gases in an internal combustion engine comprising:

a. housing means defining an exhaust gas inlet and an exhaust gas outlet;

b. valve means operable to control the flow of exhaust gas from said outlet to said inlet;

c. a moveable pressure transducer assembly operatively connected to said valve means and including:

1. means defining an air bleed chamber including a first pressure responsive means;

2. means defining a control chamber, including a second pressure responsive means and said first pressure responsive means;

3. means defining an engine load sensing chamber including a third pressure responsive member and said second pressure responsive means;

4. means defining a power signal chamber including said first pressure responsive means and means defining a port communicating said power signal chamber and said air bleed chamber;
5. bleed valve means operatively connected to said first pressure responsive means for controlling flow through said port;
6. means for porting said air bleed chamber to the atmosphere;
7. means for effecting fluid communication between said control chamber and said exhaust gas inlet; and
8. means for effecting fluid communication between said sensing chamber and a source of engine inlet manifold pressure;

and said transducer assembly moves said valve means in response to variations in engine exhaust and inlet manifold pressure to control the recirculation of exhaust gas in response to changes in engine speed and load.

* * * * *

UNITED STATES PATENT OFFICE
CERTIFICATE OF CORRECTION

Patent No. 4,116,182 Dated September 26, 1978

Inventor(s) Cyril E. Bradshaw

It is certified that error appears in the above-identified patent and that said Letters Patent are hereby corrected as shown below:

Column 6, Claim 2, lines 7 and 9, "valve" and "valves" should read "value" and "values"

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*